US007392627B2

(12) United States Patent
Sondermann

(10) Patent No.: US 7,392,627 B2
(45) Date of Patent: Jul. 1, 2008

(54) PROFILED RAIL SYSTEM FOR BRIDGING FLOORCOVERING TRANSITIONS

(75) Inventor: Frank Sondermann, Drolshagen (DE)

(73) Assignee: Hermann Friedrich Kuenne GmbH & Co., Luedenscheid (DE)

( * ) Notice: Subject to any disclaimer, the term of this patent is extended or adjusted under 35 U.S.C. 154(b) by 329 days.

(21) Appl. No.: 11/035,825

(22) Filed: Jan. 14, 2005

(65) Prior Publication Data

US 2005/0188628 A1 Sep. 1, 2005

(30) Foreign Application Priority Data

Jan. 16, 2004 (DE) ..... 20 2004 000 706 U

(51) Int. Cl.
*E04F 15/14* (2006.01)

(52) U.S. Cl. ..... 52/464; 52/395; 52/466; 52/468

(58) Field of Classification Search ..... 52/177, 52/393, 394, 395, 396.01, 396.02, 396.04, 52/396.05, 396.06, 396.07, 396.08, 396.09, 52/396.1, 402, 222, 202, 63, 459, 464, 461, 52/466, 468, 716.1, 718.04; 24/DIG. 39, 24/DIG. 41, DIG. 51, 462, 460; 248/311.3, 248/312.1, 314, 292.12, 230.1; 16/16
See application file for complete search history.

(56) References Cited

U.S. PATENT DOCUMENTS 3,254,361 A * 6/1966 Craven et al. ..... 16/16
3,473,278 A * 10/1969 Gossen ..... 52/288.1
3,688,340 A * 9/1972 Schoenbrod ..... 16/91
3,696,461 A * 10/1972 Kelly ..... 16/16
4,067,155 A * 1/1978 Ruff et al. ..... 52/105
4,156,300 A * 5/1979 Jarjavail et al. ..... 16/5
4,189,880 A * 2/1980 Ballin ..... 52/202
4,858,405 A * 8/1989 Christie ..... 52/208
5,155,952 A * 10/1992 Herwegh et al. ..... 52/100

(Continued)

FOREIGN PATENT DOCUMENTS

DE 200 15 244 U1 9/2000

(Continued)

*Primary Examiner*—Robert Canfield
*Assistant Examiner*—Jessie Fonseca
(74) *Attorney, Agent, or Firm*—Robert L. Epstein; Epstein Drangel Bazerman & James, LLP

(57) ABSTRACT

A profiled rail system (1) is used for bridging floorcovering transitions, ends or staircase edges. The profiled rail system (1) has a base profile (2) and a covering profile (3). The base profile (2) has at least one vertical leg (6), on which an inner shell (9) of a rotary joint (10) is provided. This rotary joint (10) supports the covering profile (3) such that it can be pivoted. For this purpose, two webs (11) oriented downward are provided on the covering profile (3) and, in order to form an outer shell of the rotary joint (10), have at least two partly cylindrical inner contours (12) which lie one above another. These inner contours (12) are formed so as to match the inner shell (9) of the rotary joint (10). In this way, step by step adjustability of the covering profile (3) is implemented. The rotary joint (10) can be clicked as desired into respectively one of the partly cylindrical inner contours (12). In addition, the partly cylindrical inner contours (12) ensure pivotable mounting of the covering profile (3) with respect to the base profile (2).

5 Claims, 5 Drawing Sheets

U.S. PATENT DOCUMENTS

Figure 1:
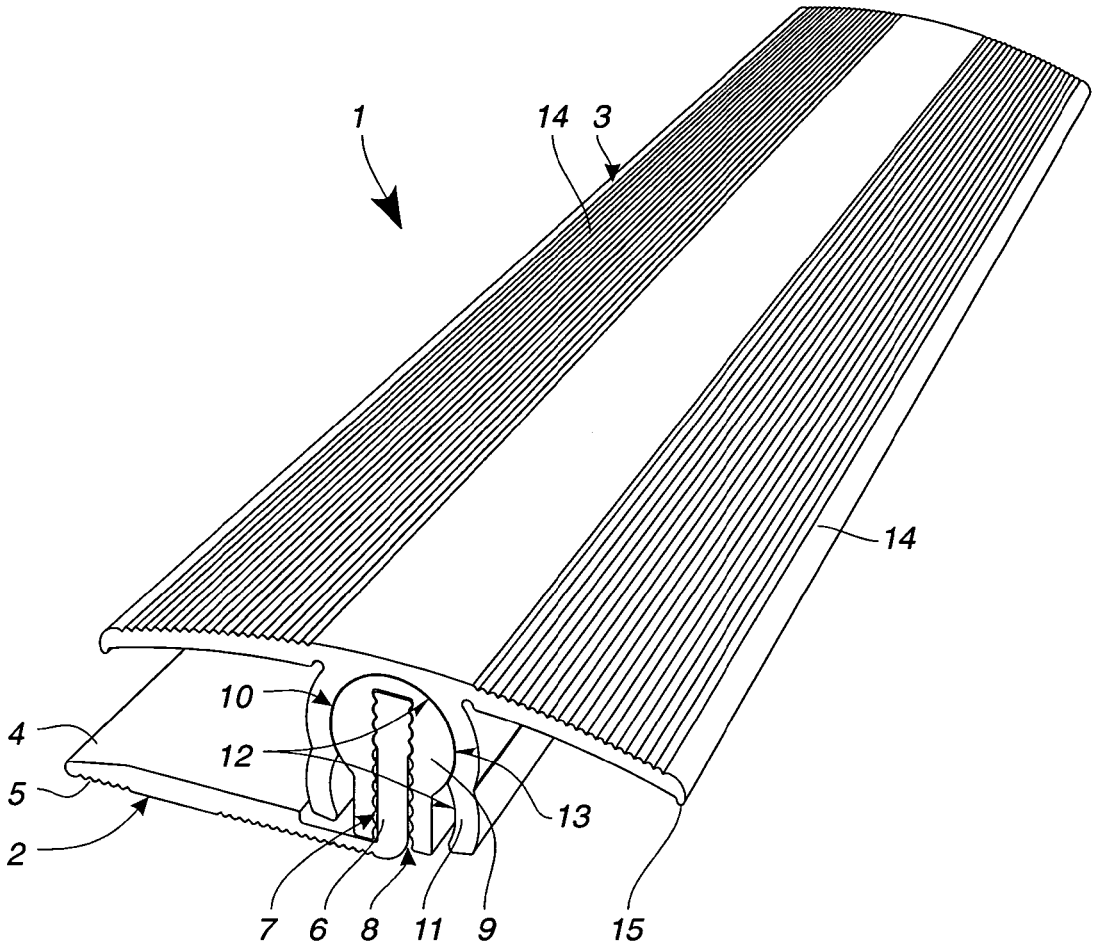

| | | | | |
|---|---|---|---|---|
| 5,657,598 | A * | 8/1997 | Wilbs et al. | 52/287.1 |
| 5,939,670 | A * | 8/1999 | Shteynberg et al. | 174/481 |
| 6,357,192 | B1 * | 3/2002 | Schluter | 52/459 |
| 6,550,205 | B2 * | 4/2003 | Neuhofer, Jr. | 52/464 |
| 6,647,680 | B2 | 11/2003 | Daly et al. | |
| 2002/0000072 | A1 * | 1/2002 | McGrath et al. | 52/466 |
| 2002/0050109 | A1 * | 5/2002 | Grosjean | 52/393 |
| 2002/0095895 | A1 * | 7/2002 | Daly et al. | 52/464 |
| 2003/0051426 | A1 * | 3/2003 | Kornfalt | 52/396.1 |
| 2003/0154678 | A1 * | 8/2003 | Stanchfield | 52/468 |

FOREIGN PATENT DOCUMENTS

| | | | |
|---|---|---|---|
| EP | 1183972 | A1 * | 3/2002 |
| EP | 1 223 368 | A1 | 7/2002 |
| EP | 1403444 | A1 * | 3/2004 |

* cited by examiner

PROFILED RAIL SYSTEM FOR BRIDGING FLOORCOVERING TRANSITIONS

This application claims the priority of German Patent Application No. 20 2004 000 706, filed Jan. 16, 2004.

The invention relates to a profiled rail system, comprising a base profile and a covering profile.

EP 1 223 268 A1 discloses a profiled rail system of the generic type for bridging floorcovering transitions, which is formed by a base profile and a covering profile. The base profile has a horizontal fixing leg and two vertical legs, which have a partly cylindrical shape on the inside and form an outer shell of a rotary joint. Retained between these two vertical legs is a rotary body, which forms an inner shell of the rotary joint and can be pivoted relative to the base profile. A web belonging to the covering profile engages in this rotary body and is held in the rotary body by means of self-tapping screws. Vertical adjustment of the covering profile is not provided in the case of this floor strip and cannot be implemented technically either.

DE 200 15 244 U1 discloses a further profiled rail system for floorcoverings. This comprises a base profile having two webs which are oriented upward and provided on the inside with sawtooth profiling. In addition, the profiled rail system has a covering profile, whose downwardly oriented web has an approximately cylindrical widening. In this widened region, the web is provided on the outside with corresponding sawtooth profiling. This profiled rail system permits vertical adjustment and pivoting of the covering profile relative to the base profile. However, the two types of movement are made possible by the same sawtooth profiling, so that as it is pressed into the base profile, the covering profile experiences only a moderate guiding action. This makes it more difficult to mount the covering profile.

The invention is based on the object of providing a profiled rail system of the type mentioned at the beginning which is distinguished by the possibility of more universal use and by facilitated mounting.

According to the invention, this object is achieved by the features of patent claim 1.

The profiled rail system according to the invention is used for bridging floorcovering transitions, in particular having different heights. For this purpose, it has a base profile, which is inserted into a joint between the adjacent floorcoverings and is fixed therein. The base profile can be fixed in the joint, for example by means of adhesive bonding or screws. The base profile has at least one vertical leg, on which a shell of a rotary joint is provided. Supported on this rotary joint is a covering profile, which preferably rests with covering wings on the two floorcoverings and covers the joint between the floorcoverings. The outer shell of the rotary joint is formed by two downwardly oriented webs of the covering profile, which have partly cylindrical inner contours. In order to achieve vertical adjustability of the profiled rail system, at least two of these partly cylindrical inner contours are provided one above another on the webs. The covering profile can therefore be adjusted step by step to a considerable extent, in order to achieve adaptation to different floorcovering thicknesses. The partly cylindrical inner contours of the webs are formed so as to match the inner shell of the rotary joint, so that the result is a good ability of the covering profile to be pivoted with respect to the base profile. When the covering profile is pivoted, the rotary joint remains within the partly cylindrical inner contour of the webs, into which the rotary joint has been clicked or axially slipped. The result is, therefore, an ability of the covering profile to be pivoted easily relative to the rotary joint, which is in particular independent of the vertical adjustability. Therefore, the covering profile is guided cleanly during all movements and can thus be mounted very easily.

In order to prevent the webs in the region of the lower, partly cylindrical inner contours impairing the ability of the covering profile to be pivoted, it is beneficial if the lower inner contours of the webs engage around the inner shell of the rotary joint by at most 60° in each case from both sides. These inner contours preferably engage around the inner shell by at most 45°. Therefore, even in the event of a low floorcovering thickness, an adequate ability of the covering profile to be pivoted is ensured.

In order to improve the vertical adjustability of the covering profile further, it is beneficial if the inner shell of the rotary joint is supported on the vertical web of the base profile such that it can be adjusted vertically. The inner shell of the rotary joint in this case forms a separate part, which can be adjusted both with respect to the base profile and with respect to the covering profile. This additional adjustment results in an increased vertical adjustment range, which is added to the step by step adjustability of the covering profile with respect to the inner shell of the rotary joint. In addition, this vertical adjustability can be designed to be continuous or at least very finely stepped, so that the result is particularly exact adaptation of the covering profile to the respective floorcovering thicknesses.

One simple implementation of the vertical adjustability of the inner shell of the rotary joint results from a vertical groove in the rotary joint. The vertical web of the base profile engages in this vertical groove, so that the inner shell of the rotary joint is guided such that it can be displaced in the vertical direction. This vertically adjustable retention of the inner shell of the rotary joint in no way disrupts the ability of the covering profile to be pivoted, the result being a particularly compact construction of the profiled rail system.

For the purpose of simple locking of the inner shell of the rotary joint, it is beneficial if the walls of the groove and the vertical web of the base profile have toothed profiling systems which match one another. These toothed profiling systems can be formed symmetrically, in order to achieve the same retaining forces upward and downward. Alternatively, the toothed profiling systems can also be formed in the manner of a sawtooth, in order to achieve an increased retaining force of the covering profile with a correspondingly reduced insertion force.

Finally, it is advantageous to provide the inner contours of the webs and the outer contours of the inner shell of the rotary joint with toothed profiling systems which match one another. In this way, although the covering profile can be rotated with respect to the base profile, the covering profile remains securely in the respective pivoted position after mounting, so that the covering profile is particularly easy to mount. In addition, undesired pivoting of the covering profile in the event of oscillations of the floorcoverings is reliably prevented in this way.

Further advantages and features of the present invention will be presented in the following detailed description using the associated figures, which contain a plurality of exemplary embodiments of the present invention. However, it should be understood that the drawing serves merely for the purpose of illustrating the invention and not restricting the scope of protection of the invention.

Figure 2:
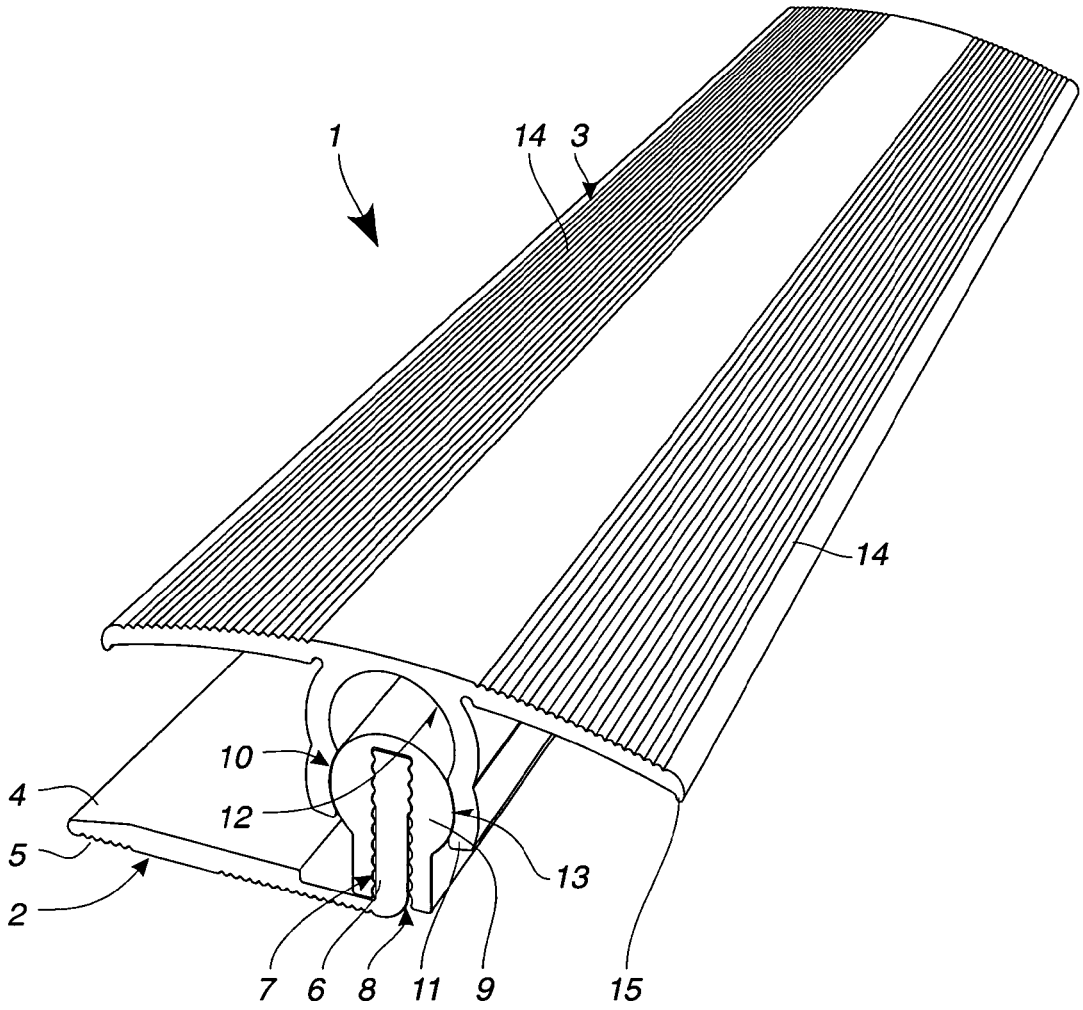
Figure 3:
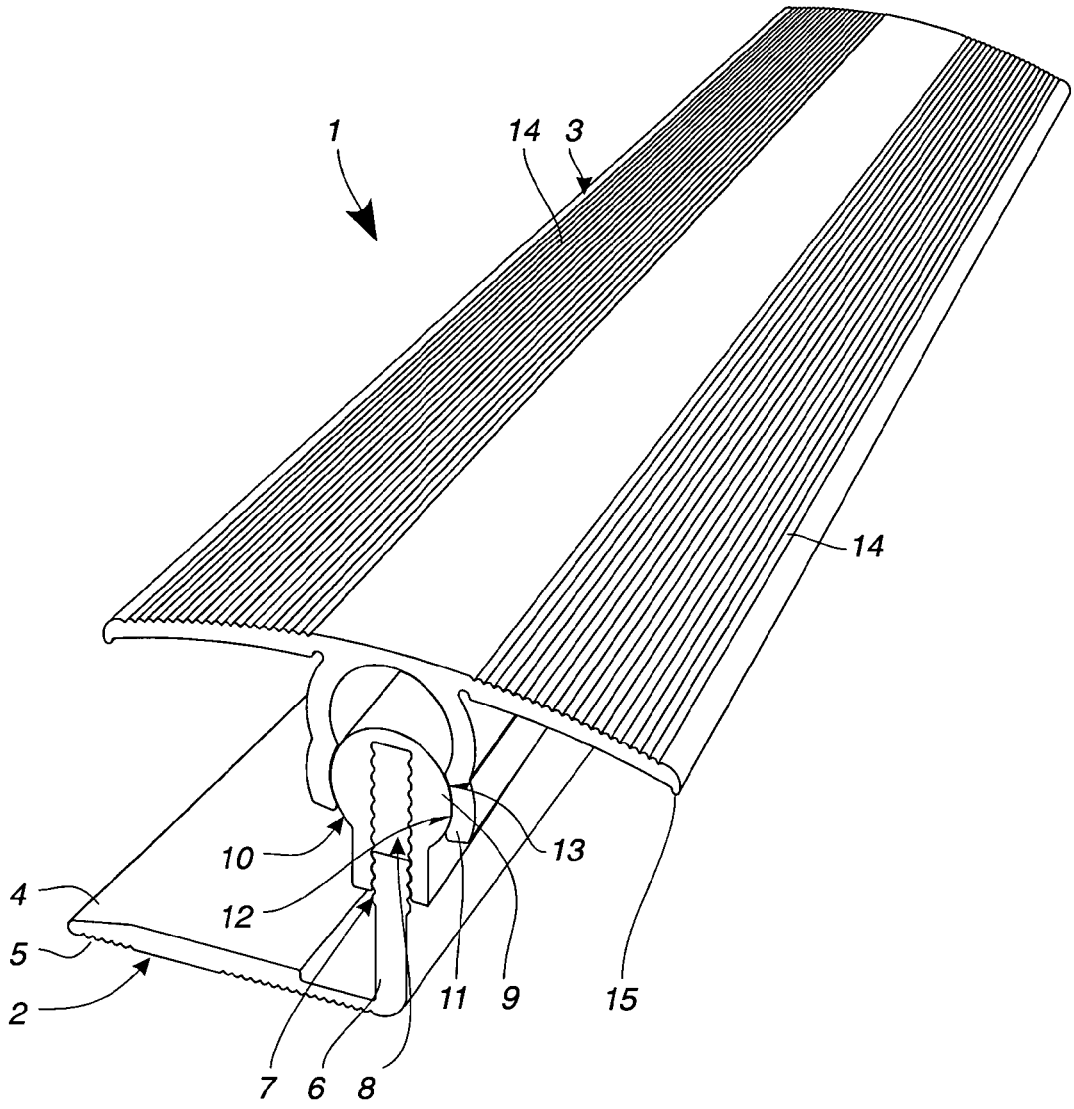
Figure 4:
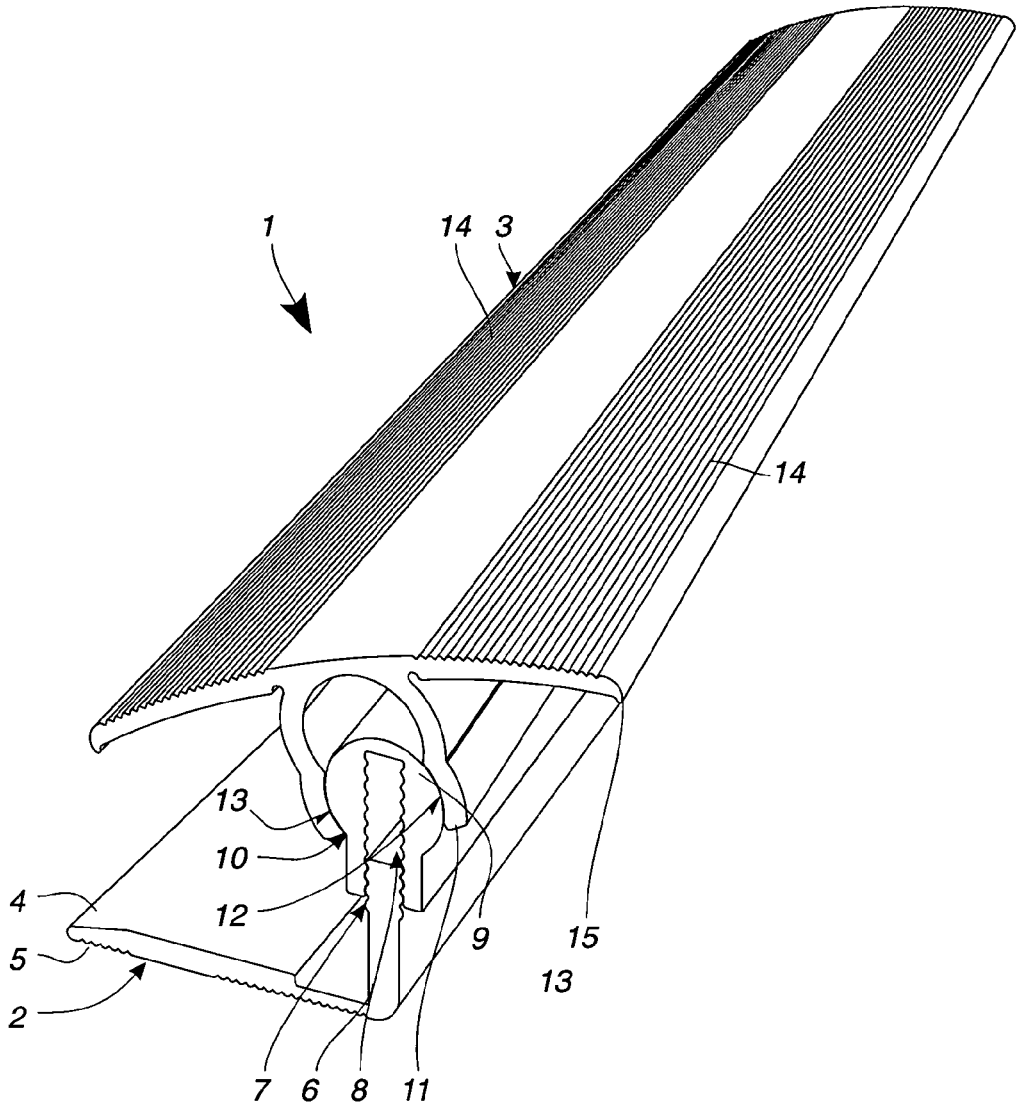
Figure 5:
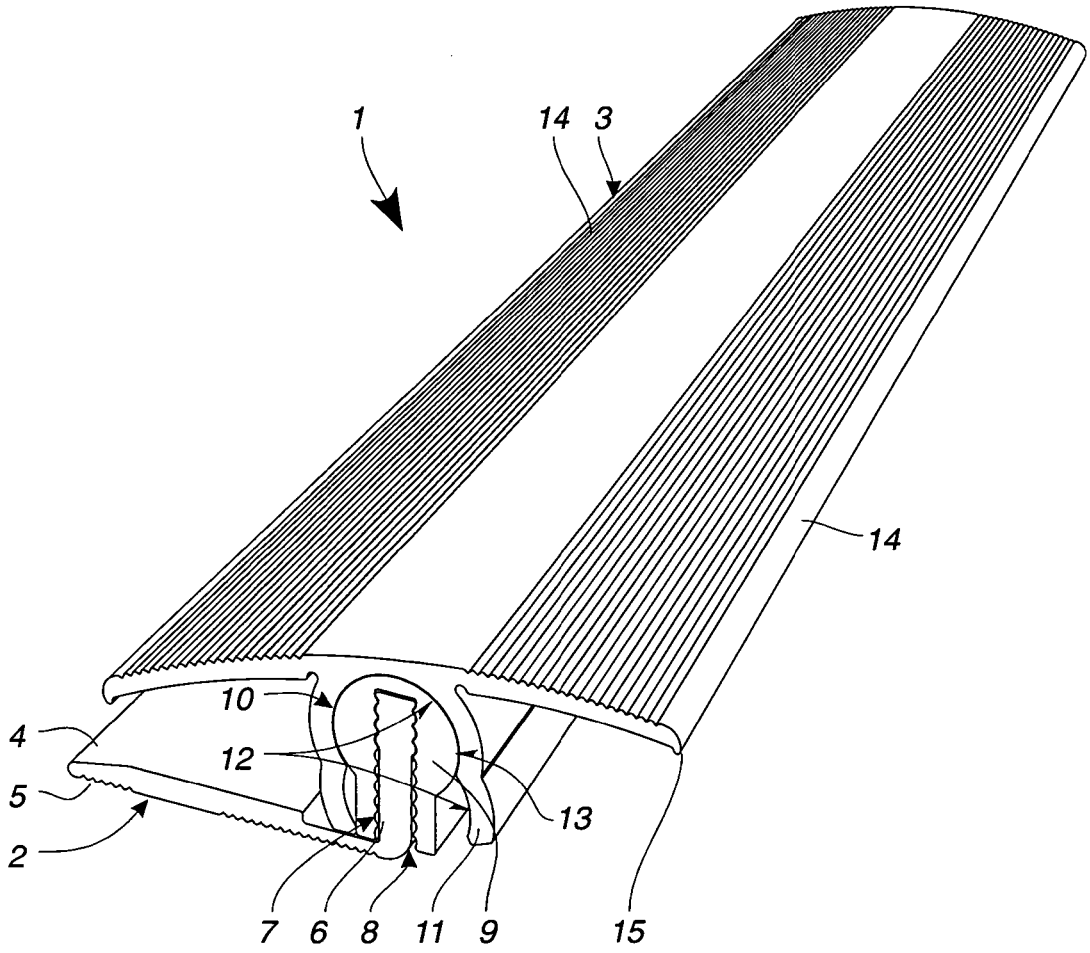

In the drawings:

FIG. 1 shows a perspective illustration of a profiled rail system in a position for low floorcovering thicknesses, FIG. 2 shows the profiled rail system according to FIG. 1 for medium floorcovering thicknesses, FIG. 3 shows the profiled rail system according to FIG. 2 for high floorcovering thicknesses, FIG. 4 shows the profiled rail system according to FIG. 3 in a pivoted position of the covering profile, and FIG. 5 shows the profiled rail system according to FIG. 1 in a pivoted position of the covering profile.

A profiled rail system 1 according to FIG. 1 comprises a base profile 2 and a covering profile 3. The base profile 2 has a horizontal leg 4, which is fixed in a joint, for example by means of adhesive bonding or screws. For this purpose, the horizontal leg 4 has profiling 5 on the underside, which effects improved adhesion of the adhesive employed. In addition, holes (not illustrated) which can be penetrated by appropriate retaining screws are provided in the horizontal leg 4.

In addition, the base profile 2 has a vertical leg 6, which is provided on both sides with a toothed profiling system 7. This vertical leg 6 engages in a groove 8 of a part 9 which forms the inner shell 9 of a rotary joint 10. This groove 8 is likewise provided with a matching toothed profiling system 7, so that the inner shell 9 of the rotary joint 10 is held such that it can be displaced vertically with respect to the base profile 2. In this case, the toothed profiling system 7 ensures firm retention of the inner shell 9 of the rotary joint 10 on the base profile 2.

On the inner shell 9 of the rotary joint 10, the covering profile 3 is supported by means of two downwardly oriented vertical webs 11. These vertical webs 11 have two partly cylindrical inner contours 12 which are placed one above another and which are matched to the outer contour 13 of the inner shell 9 of the rotary joint 10. In this way, the result is an ability of the covering profile 3 to be pivoted and adjusted vertically with respect to the base profile 2. The covering profile 3 has two covering wings 14, which rest with lips 15 on the adjacent floorcoverings. The covering profile 3 therefore completely covers the joint provided between the floorcoverings.

FIG. 2 shows the profiled rail system according to FIG. 1, the same reference symbols designating the same parts. As distinct from the design according to FIG. 1, the covering profile 3 has been displaced upward with respect to the inner shell 9 of the rotary joint 10, so that the inner shell 9 of the rotary joint 10 is gripped by the lower partly cylindrical inner contour 12 of the vertical webs 11. In this way, as compared with the position according to FIG. 1, the result is a considerably larger vertical spacing of the covering profile 3 from the base profile 2, in order to be able to cover floorcoverings of medium thickness securely.

In the position according to FIG. 3, the inner shell 9 of the rotary joint 10 has additionally been displaced vertically upward, in order to enlarge the vertical spacing of the covering profile 3 from the base profile 2. In this way, even relatively thick floorcoverings can be covered without having to change the profiled rail system 1. Since the inner shell 9 of the rotary joint 10 can be adjusted virtually continuously with respect to the base profile 2, virtually any desired floorcovering thicknesses can be covered in this way. Of course, consideration is also given to using the ability of the inner shell 9 of the rotary joint 10 to be displaced in the position of the covering profile according to FIG. 1. By means of these combinations, all floorcovering thicknesses which occur in practice can be covered reliably.

FIG. 4 shows the profiled rail system 1 according to FIG. 3 in a pivoted position of the covering profile 3. In this case, the rotary joint 10 formed by the webs 6 and the inner shell 9 is used for the purpose of pivoting the covering profile 3, in order to be able to compensate safely for different floorcovering thicknesses.

Finally, FIG. 5 shows the profiled rail system 1 according to FIG. 1 in a pivoted position. This illustration reveals in particular the fact that the webs 6 should not be too long in the region of the lower partly cylindrical inner contour 12, since otherwise the ability of the covering profile 3 to be pivoted when employed for thin floorcoverings would no longer be ensured.

As an alternative to the exemplary embodiment illustrated, the covering wings 14 can also be formed with different lengths, in order to increase the vertical compensation between the floorcoverings further.

Since some exemplary embodiments of the present invention have not been shown or described, it must be understood that a large number of changes and modifications of these exemplary embodiments described are possible without departing from the substantial idea and the scope of protection of the invention which is defined by the claims.

List of reference symbols

| | |
|---|---|
| 1 | Profiled rail system |
| 2 | Base profile |
| 3 | Covering profile |
| 4 | Horizontal web |
| 5 | Profiling |
| 6 | Vertical web |
| 7 | Toothed profiling system |
| 8 | Groove |
| 9 | Inner shell |
| 10 | Rotary joint |
| 11 | Vertical web |
| 12 | Partly cylindrical inner contour |
| 13 | Outer contour |
| 14 | Covering wing |
| 15 | Lip |

The invention claimed is:

1. A profiled rail system for bridging floor covering transitions, ends or staircase edges, the profiled rail system having a base, a covering profile and a means for mounting said covering profile on said base for relative vertical and pivotal movement therebetween, said mounting means comprising a vertical leg extending from said base and a joint, said joint comprising an inner shell defining a recess into which said vertical leg is received and an outer shell defining a recess into which said inner shell is received, said inner shell comprising a substantially smooth, cylindrical outer surface portion, said outer shell recess comprising first and second substantially vertically aligned, substantially cylindrical recess portions, each of said recess portions comprising a substantially smooth inner surface and substantially corresponding in shape to said outer surface portion of said inner shell, the position and orientation of said covering profile relative to said base being adjustable by moving said inner shell into a selected one of said outer shell recess portions with said substantially smooth, cylindrical outer surface portion of said inner shell adjacent said substantially smooth inner surface of said selected outer recess portion, thereby permitting said inner shell to be freely pivoted relative to said outer shell.

2. The profiled rail system of claim 1, wherein each of said outer shell recess portions engages around inner shell of the rotary joint by at most 60° in each case from both sides.

3. The profiled rail system of claim 1, wherein said inner shell of said rotary joint is supported on said vertical leg of the base in a vertically adjustable manner.

4. The profiled rail system of in claim 3, said recess of said inner shell of said rotary joint engages said vertical leg of the base in a vertically adjustable manner.

5. The profiled rail system of claim 4, wherein said recess of said inner shell of said rotary joint and said surface of said vertical leg comprise interlocking toothed surfaces.

* * * * *